US005857171A

United States Patent [19]

Kageyama et al.

[11] Patent Number: 5,857,171

[45] **Date of Patent: *Jan. 5, 1999**

[54] KARAOKE APPARATUS USING FREQUENCY OF ACTUAL SINGING VOICE TO SYNTHESIZE HARMONY VOICE FROM STORED VOICE INFORMATION

[75] Inventors: Yasuo Kageyama, Hamamatsu; Hiroshi Mino, Tokyo, both of Japan

[73] Assignee: Yamaha Corporation, Hamamatsu, Japan

[ * ] Notice: The term of this patent shall not extend beyond the expiration date of Pat. No. 5,719,346.

[21] Appl. No.: 607,341

[22] Filed: Feb. 26, 1996

[30] Foreign Application Priority Data

Feb. 27, 1995 [JP] Japan ..... 7-038465

[51] Int. Cl.[6] ..... G10H 1/36; G10L 5/04

[52] U.S. Cl. ..... 704/268; 704/270; 84/610

[58] Field of Search ..... 395/2.77, 2.79, 395/2.67, 2.7, 2.87, 2.09, 2.69, 2.81; 84/610, 634, 625, 609, 631; 434/307 A

[56] References Cited

U.S. PATENT DOCUMENTS

| | | | |
|---|---|---|---|
| 4,731,847 | 3/1988 | Lybrook et al. | 395/2.69 |
| 5,231,671 | 7/1993 | Gibson et al. | 395/2.14 |
| 5,447,438 | 9/1995 | Watanabe et al. | 434/307 A |
| 5,518,408 | 5/1996 | Kawashima et al. | 434/307 A |
| 5,521,326 | 5/1996 | Sone | 84/631 |
| 5,621,182 | 4/1997 | Matsumoto | 84/610 |
| 5,642,470 | 6/1997 | Yamamoto et al. | 704/270 |
| 5,719,346 | 2/1998 | Yoshida et al. | 84/631 |

FOREIGN PATENT DOCUMENTS

| | | | |
|---|---|---|---|
| 282458 | 9/1988 | European Pat. Off. | G10H 1/38 |
| 396141 | 11/1990 | European Pat. Off. | G10H 5/00 |
| 509812 | 10/1992 | European Pat. Off. | G10H 1/36 |
| 88 05200 | 7/1988 | WIPO | G10G 1/00 |

OTHER PUBLICATIONS

"Microsoft Press Computer Dictionary," Microsoft Press, Redmond, Washington (1994) p. 257.

*Primary Examiner*—David R. Hudspeth
*Assistant Examiner*—Donald L. Storm
*Attorney, Agent, or Firm*—Pillsbury Madison & Sutro LLP

[57] ABSTRACT

A karaoke apparatus produces a karaoke accompaniment which accompanies a singing voice of an actual player, and concurrently creates a harmony voice originating from a virtual player. In the karaoke apparatus, a memory device stores voice information of the virtual singer. An input device collects the singing voice of the actual player. An analyzing device analyzes an audio frequency of the collected singing voice. A synthesizing device processes the stored voice information based on the analyzed audio frequency to synthesize the harmony voice having another audio frequency which is set in harmony with the analyzed audio frequency. An output device mixes the collected singing voice and the synthesized harmony voice with each other, and outputs the mixed singing and harmony voices along with the karaoke accompaniment. In one preferred embodiment, the memory device stores the voice information in the form of a sequence of phonetic elements that are successively sampled syllable by syllable from a singing voice of the virtual player.

6 Claims, 8 Drawing Sheets

KARAOKE APPARATUS USING FREQUENCY OF ACTUAL SINGING VOICE TO SYNTHESIZE HARMONY VOICE FROM STORED VOICE INFORMATION

BACKGROUND OF THE INVENTION

The present invention relates to a karaoke apparatus constructed to add a harmony voice to a karaoke singing voice, and more particularly to a karaoke apparatus capable of creating a virtual harmony voice resembling a voice other than that of an actual karaoke singer, for example, a voice of an original singer of the karaoke song.

In the prior art, to cheer up the karaoke singing and to improve the karaoke performance, there is known a karaoke apparatus which adds a harmony voice, for example, third degrees higher than a main melody, to the voice of the karaoke singer, and which reproduces the mixed harmony voice and singing voice. Generally, such a harmonizing function is achieved by shifting a pitch of the singing voice picked up through a microphone to generate a harmony sound in synchronization with a tempo of the singer. However, in the conventional karaoke apparatus, the generated harmony voice has the same tone as that of the karaoke singer's actual voice, so that the singing performance tends to be plain. It is hard to fulfill the desire of the karaoke singer that he or she wants to sing with the original singer of the karaoke song.

SUMMARY OF THE INVENTION

The purpose of the present invention is to provide a karaoke apparatus capable of creating a harmony voice having a tone other than that of the karaoke singer, such as a pleasant tone originating or deriving from the original singer of the karaoke song.

According to the invention, a karaoke apparatus produces a karaoke accompaniment which accompanies a singing voice of an actual player, and concurrently creates a harmony voice originating from a virtual player. The karaoke apparatus comprises a memory device that stores voice information of the virtual singer, an input device that collects the singing voice of the actual player, an analyzing device that analyzes the audio frequency of the collected singing voice, a synthesizing device that processes the stored voice information based on the analyzed audio frequency to synthesize the harmony voice having another audio frequency which is set in harmony with the analyzed audio frequency, and an output device that mixes the collected singing voice and the synthesized harmony voice with each other, and that outputs the mixed singing and harmony voices along with the karaoke accompaniment.

In a specific form, the memory device stores the voice information in the form of a sequence of phonetic elements which are successively sampled syllable by syllable from a singing voice of the virtual player. Further, the synthesizing device successively reads out each phonetic element from the memory device in synchronization with the karaoke accompaniment to synthesize each syllable of the harmony voice corresponding to each syllable of the singing voice. Moreover, the memory device further stores harmony information representative of a melody pattern of the harmony voice, and the synthesizing device shifts the analyzed audio frequency according to the stored harmony information to set said another audio frequency of the harmony voice.

The karaoke apparatus according to the present invention stores characteristics of the voice of the virtual player such as an original singer of the karaoke song in the voice information memory device. As the actual karaoke player inputs his singing voice via a microphone, the frequency analyzing device analyzes the audio frequency of the input singing voice. The harmony voice synthesizing device synthesizes the harmony voice at a shifted frequency harmonizing with the analyzed frequency according to the voice information. The singing voice and the harmony voice generated as described in the foregoing are mixed with each other to output the karaoke singing voice accompanied with the harmony voice of the virtual player such as the original singer of the karaoke song. The voice characteristic memory device stores the voice information on a syllable by syllable basis to sequentially reconstruct the syllables of the harmony voice of the virtual player. Utilizing the syllable elements, it is possible to generate the harmony voice having the good tone of the original singer. The harmony voice synthesizing device retrieves and processes the syllable elements in synchronism with the progress of the karaoke song. Thus, the harmony voice can be generated corresponding to each syllable of the singing voice.

DETAILED DESCRIPTION OF THE INVENTION

Figure 1:
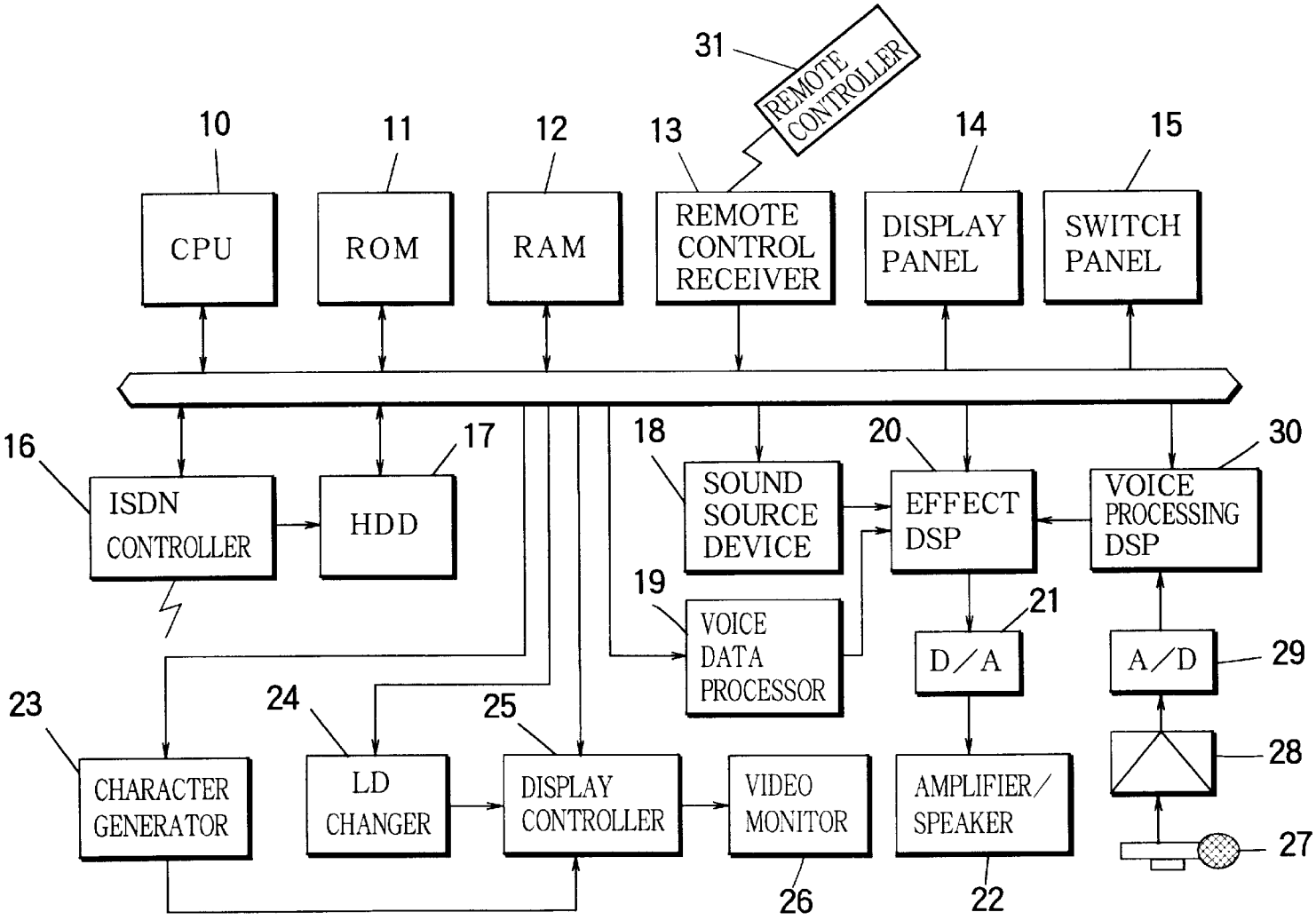
FIG. 1 is a schematic block diagram showing a karaoke apparatus having a harmony creating function according to the present invention.

Details of embodiments of the karaoke apparatus having a harmony creating function according to the present invention will now be described with reference to the Figures. The karaoke apparatus of the invention is a so-called a sound source karaoke apparatus. The sound source karaoke apparatus generates accompanying instrumental sounds by driving a sound source according to song data. The song data is a sequence data arranged in a multiple of tracks containing performance data sequences specifying a pitch and timing of the karaoke accompaniment. Further, the karaoke apparatus of the invention is structured as a network communication karaoke device, which connects to a host station through a communication network. The karaoke apparatus receives the song data downloaded from the host station, and stores the song data in a hard disk drive (HDD) 17 (FIG. 1). The hard disk drive 17 can store several hundreds to several thousands of the song data. The harmony creating function of the karaoke apparatus is to create harmony audio signals having a pitch difference of third or fifth degrees relative to the singing voice of the karaoke singer. In the karaoke apparatus, the harmony voice is generated at the pitch of the third or fifth degrees relative to the karaoke singer's voice with a tone of an original singer of the karaoke song.

Figure 3:
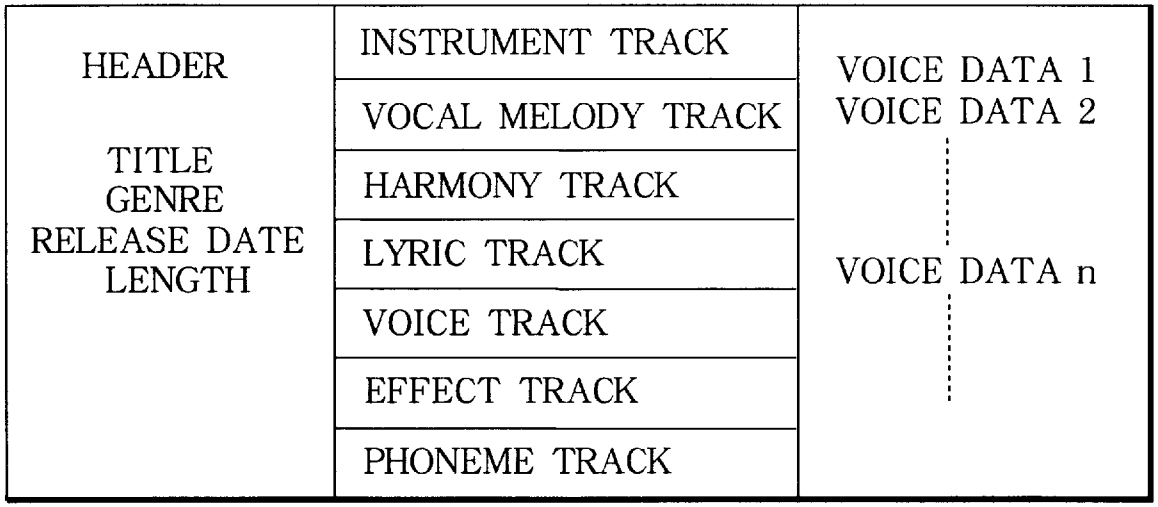
FIG. 3 shows configuration of song data utilized in the karaoke apparatus.

Now the configuration of the song data used in the karaoke apparatus of the present invention is described with reference to FIGS. 3 to 6B. FIG. 3 shows an overall configuration of the song data, FIGS. 4 and 5A–5F show the detailed configuration of the song data, and FIGS. 6A and 6B show the structure of phoneme data included in the song data.

In FIG. 3, the song data of one music piece comprises a header, an instrumental sound or instrument track, a vocal or main melody track, a harmony track, a lyric track, a voice track, an effect track, a phoneme track, and a voice data block. The header contains various index data relating to the song data, including the title of the song, the genre of the song, the date of the release of the song, the performance time (length) of the song and so on. A CPU 10 (FIG. 1) determines a background video image to be displayed on a video monitor 26 based on the genre data, and sends a chapter number of the video image to an LD changer 24. The background video image can be selected such that a video image of a snowy country is chosen for a Japanese ballad song having a theme relating to the winter season, or a video image of foreign scenery is selected for foreign pop songs.

Each track from the instrumental sound track to the phoneme track shown in FIGS. 4 and 5A–5F contains a sequence of event data and duration data Δt specifying an interval of each event data. The CPU 10 executes a sequence program, in which the duration data Δt is counted with a predetermined tempo clock. A next event data is read out after counting up Δt, and the read out event data is sent to a predetermined processing block.

Figure 4:
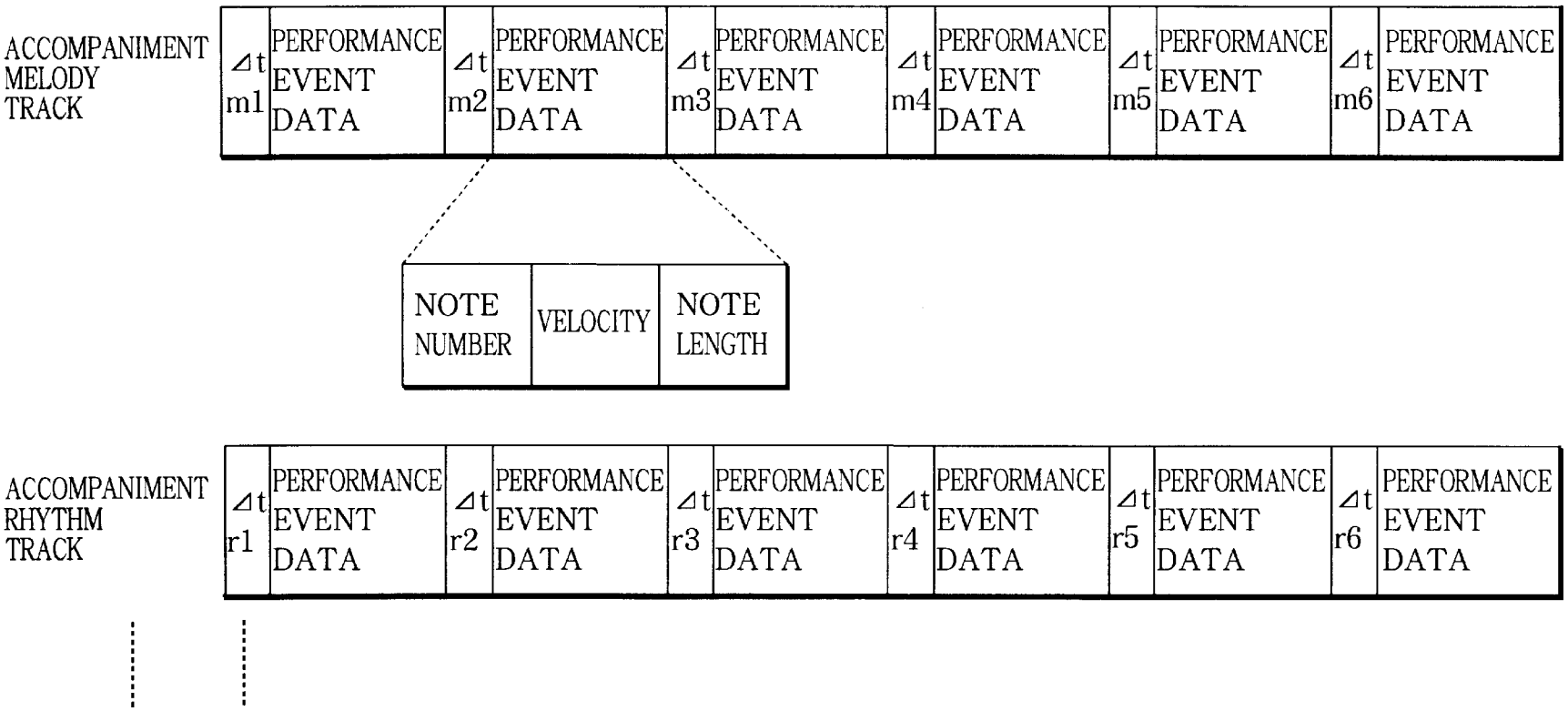
FIG. 4 shows detailed configuration of the song data utilized in the karaoke apparatus.

The instrumental sound track shown in FIG. 4 contains various sub-tracks including an accompaniment melody track, an accompaniment rhythm track and so on. Sequence data composed of performance event data and duration data Δt is written on each track. The CPU 10 executes an instrumental sequence program while counting the duration data Δt, and sends next event data to a sound source device 18 at an output timing of the event data. The sound source device 18 selects a tone generation channel according to channel designation data included in the event data, and executes the event at the designated channel so as to generate an instrumental accompaniment tone of the karaoke song.

Figure 5A:
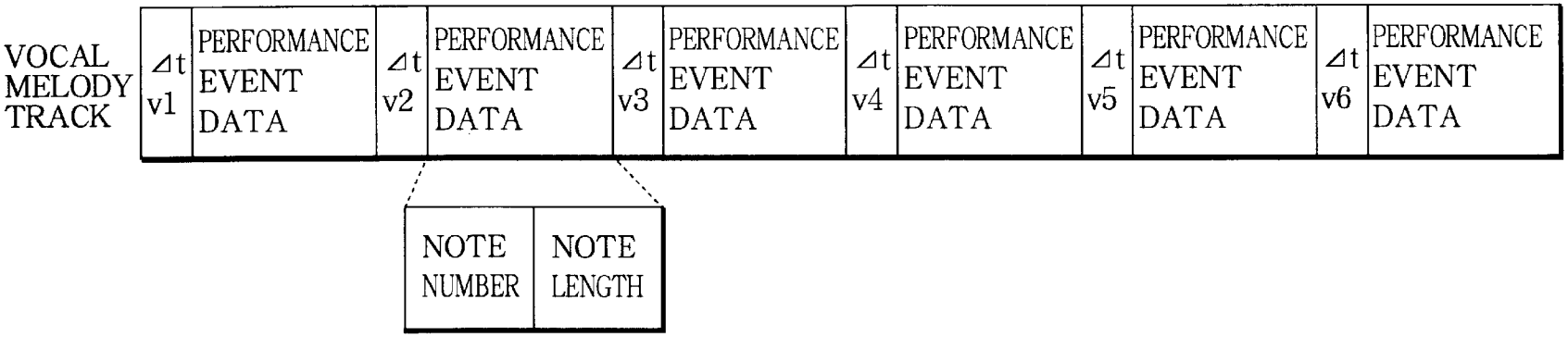
FIGS. 5A–5F show detailed configuration of the song data utilized in the karaoke apparatus.
Figure 5B:
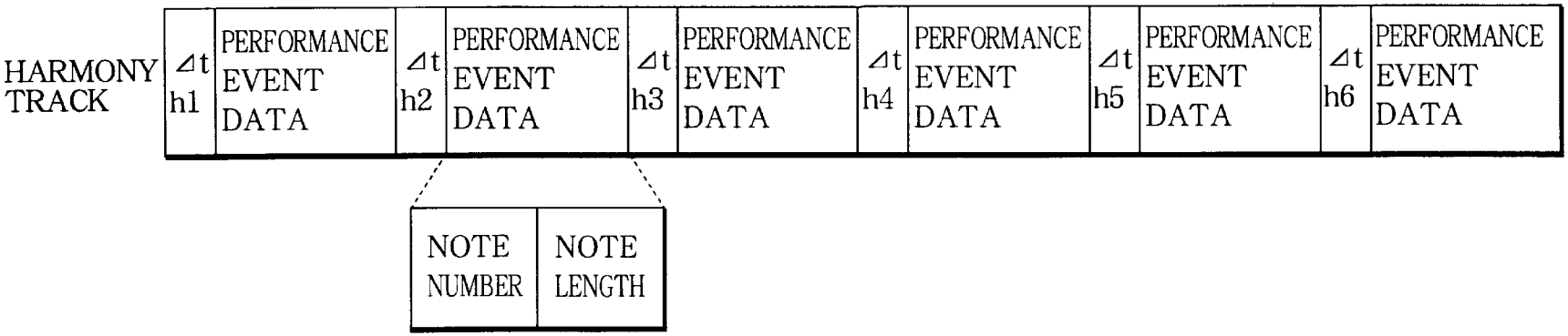
Figure 6A:
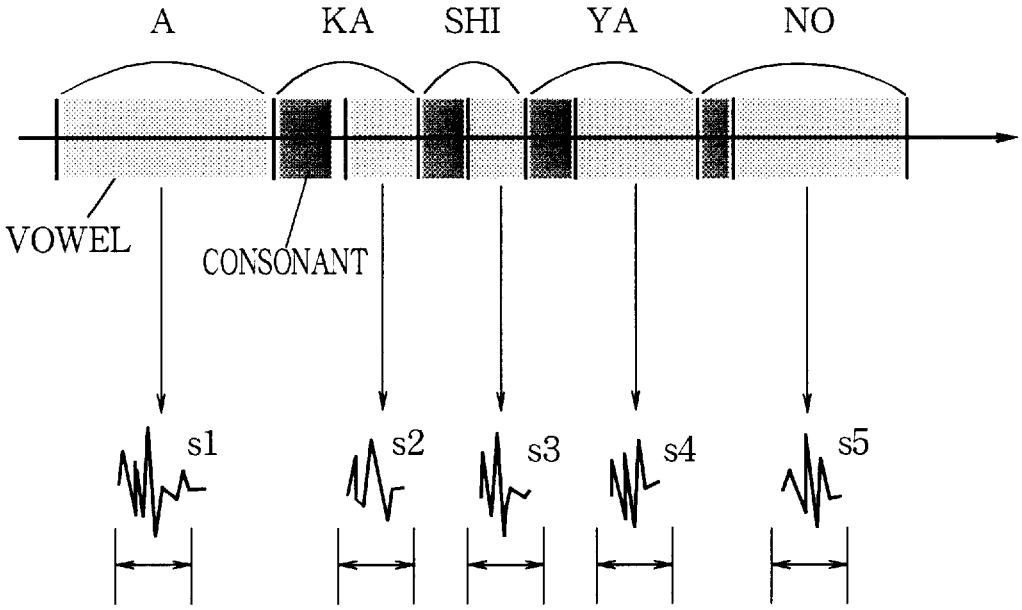
FIGS. 6A and 6B show configuration of phoneme data included in the song data.
Figure 6B:
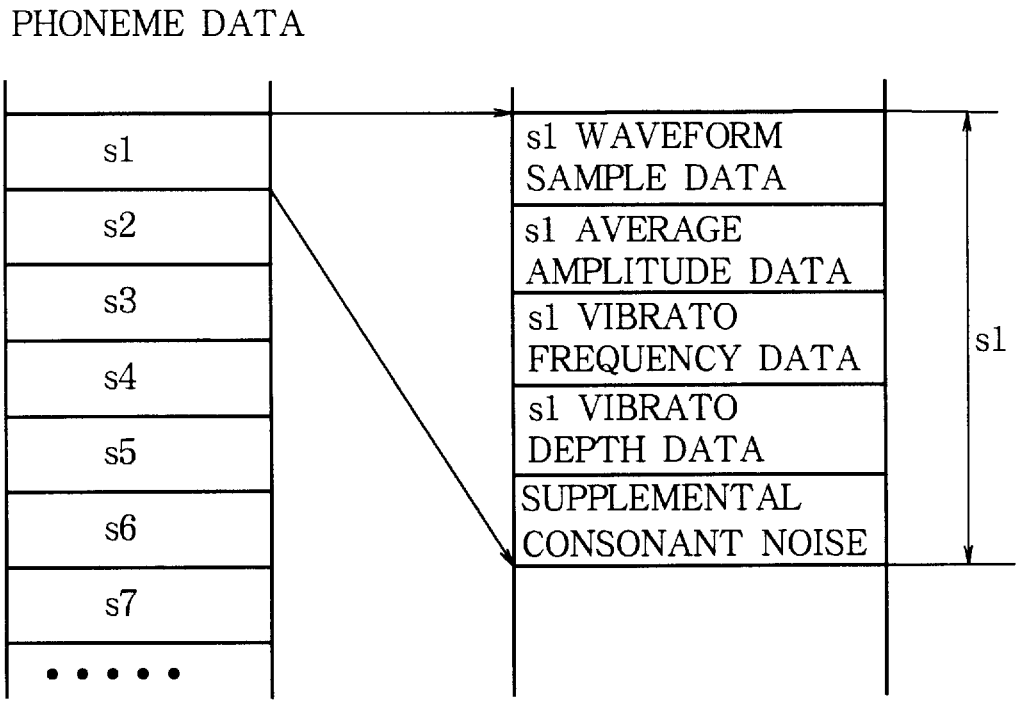

As shown in FIG. 5A, the vocal or main melody track records sequence data representative of a pattern of a main melody which should be sung by the karaoke singer. As shown in FIG. 5B, the harmony track stores sequence data representative of a pattern of a harmony melody of the karaoke song. These pattern data are read out by the CPU 10, and the read out pattern data is sent to the voice processing DSP 30 to generate the harmony voice.

Figure 5C:
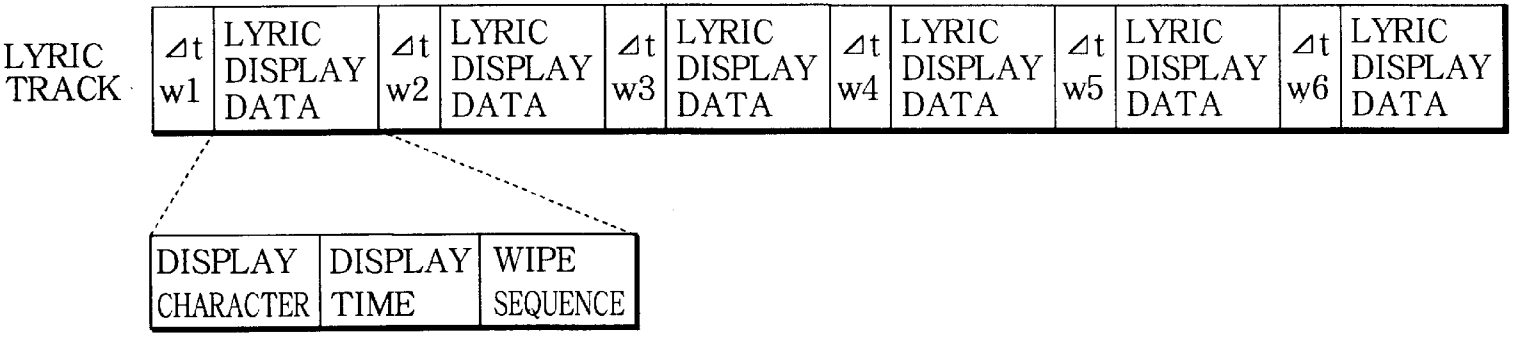

As shown in FIG. 5C, the lyric track records sequence data to display lyrics on the video monitor 26. This sequence data is not actually instrumental sound data, but this track is described also in MIDI data format for easily integrating the data implementation. The class of data is system exclusive message in MIDI standard. In the data description of the lyric track, a phrase of lyric is treated as one event of lyric display data. The lyric display data comprises character codes for the phrase of the lyric, display coordinates of each character, display time of the lyric phrase (about 30 seconds in typical applications), and "wipe" sequence data. The "wipe" sequence data is to change the color of each character in the displayed lyric phrase in relation to the progress of the song. The wipe sequence data comprises timing data (the time since the lyric is displayed) and position (coordinate) data of each character for the change of color.

Figure 5D:
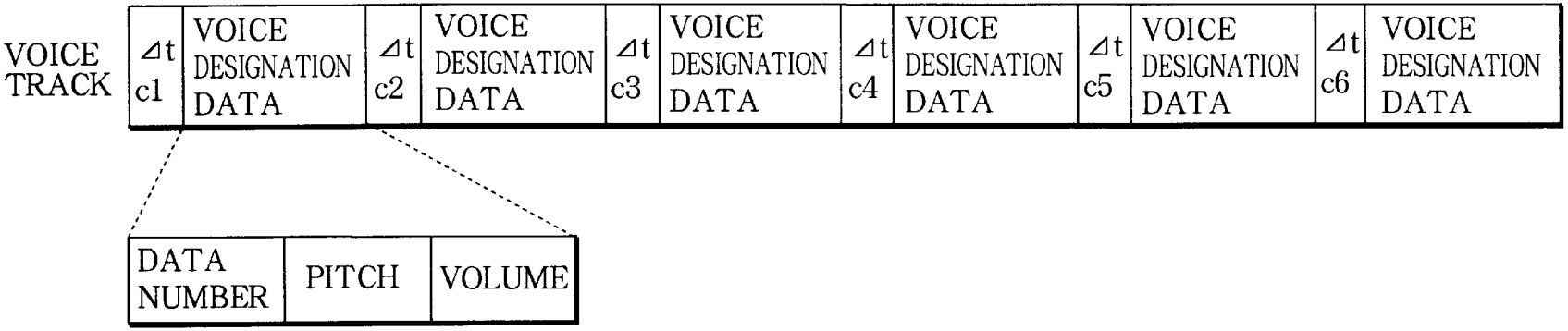

As shown in FIG. 5D, the voice track is a sequence track to control generation timing of the voice data n (n=1, 2, 3 . . . ) stored in the voice data block. The voice data block stores human voices that are hard to synthesize by the sound source device 18, such as backing chorus. On the voice track, there is written the duration data Δt, namely a readout interval of each voice designation data. The duration data Δt determines timing to output the voice data to a voice data processor 19 (FIG. 1). The voice designation data comprises a voice number, pitch data and volume data. The voice number is a code number n to identify a desired item of the voice data recorded in the voice data block. The pitch data and the volume data respectively specify the pitch and the volume of the voice data to be generated. Non-verbal backing chorus such as "Ahh" or "Wahwahwah" can be variably reproduced as many times as desired with changing pitch and volume. Such a part is reproduced by shifting the pitch or adjusting the volume of a voice data registered in the voice data block. The voice data processor 19 controls an output level based on the volume data, and regulates the pitch by changing the reading clock of the voice data based on the pitch data.

Figure 5E:
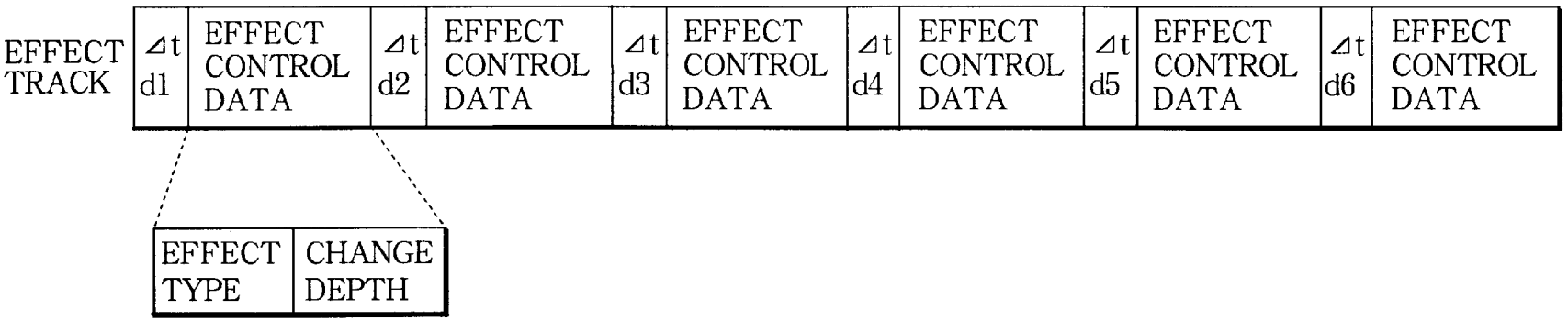

As shown in FIG. 5E, the effect track stores control data for an effector DSP 20 connected to those of the sound source device 18, the voice data processor 19 and the voice processing DSP 30. The main purpose of the effector DSP 20 is to add various sound effects such as reverberation ('reverb') to audio signals inputted from the sound source device 18, the voice data processor 19 and the voice processing DSP 30. The DSP 20 controls the effect on a real time basis according to the control data which is recorded on the effect track and which specifies the type and depth of the effect.

Figure 5F:
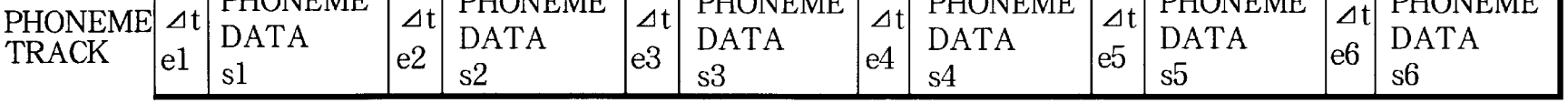

As shown in FIG. 5F, the phoneme track stores phoneme data s1, s2, . . . in time series, and duration data e1, e2, . . . representing the length of a syllable to which each phoneme belongs. The phoneme data s1, s2, s3, . . . and the duration data e1, e2, e3 . . . are alternately arranged to each other to form a sequential data format.

In FIG. 6A, a phrase of lyric 'A KA SHI YA NO' comprises five syllables 'A', 'KA', 'SHI', 'YA', 'NO', and phoneme data s1, s2, . . . are composed of extracted vowels 'a', 'a', 'i', 'a', 'o' from the five syllables. As shown in FIG. 6B, the phoneme data comprises sample waveform data encoded from a vowel waveform of a model voice of the virtual player, average magnitude (amplitude) data, vibrato frequency data, vibrato depth data, and supplemental noise data. The supplemental noise data represents characteristics of aperiodic noise contained in the model vowel. The phoneme data represents voice information of the vowels contained in the model voice of the virtual player, in terms of the waveform, envelope thereof, vibrato frequency, vibrato depth and supplemental noise.

Most tracks such as the instrumental sound track and the effect track are loaded into a RAM 12 from the hard disk drive 17. The CPU 10 reads out the data of these tracks at the beginning of the reproduction of the song data. However, the phoneme track, the vocal or main melody track and the harmony track may be directly loaded into another RAM included in the voice processing DSP 30 from the hard disk drive 17. The voice processing DSP 30 reads out the phoneme data, note event data of the main melody and note event data of the harmony melody.

FIG. 1 shows a schematic block diagram of the inventive karaoke apparatus having the harmony creating function. The CPU 10 to control the whole system is connected, through a system bus, to those of a ROM 11, a RAM 12, the hard disk drive (denoted as HDD) 17, an ISDN controller 16, a remote control receiver 13, a display panel 14, a switch panel 15, the sound source device 18, the voice data processor 19, the effect DSP 20, a character generator 23, the LD changer 24, a display controller 25, and the voice processing DSP 30.

The ROM 11 stores a system program, an application program, a loader program and font data. The system program controls basic operation and data transfer between peripherals and so on. The application program includes a peripheral device control program, a sequence program and so on. In karaoke performance, the sequence program is processed by the CPU 10 to reproduce an instrumental accompaniment sound and a background video image according to the song data. The loader program is executed to download requested song data from the host station. The font data is used to display lyrics and song titles, and various fonts such as 'Mincho' and 'Gothic' are stored as the font data. A work area is allocated in the RAM 12. The hard disk drive 17 stores song data files.

The ISDN controller 16 controls the data communication with the host station through an ISDN network. The various data including the song data are downloaded from the host station. The ISDN controller 16 accommodates a DMA controller, which writes data such as the downloaded song data and the application program directly into the HDD 17 without control by the CPU 10.

The remote control receiver 13 receives an infrared signal modulated with control data from a remote controller 31, and decodes the received control data. The remote controller 31 is provided with ten-key switches, command switches such as a song selector switch and so on, and transmits the infrared signal modulated by codes corresponding to the user's operation of the switches. The switch panel 15 is provided on the front face of the karaoke apparatus, and includes a song code input switch, a key changer switch and so on.

The sound source device 18 generates the instrumental accompaniment sound according to the song data. The voice data processor 19 generates a voice signal having a specified length and pitch corresponding to voice data included as ADPCM data in the song data. The voice data is a digital waveform data representative of backing chorus or exemplary singing voice, which is hard to synthesize with the sound source device 18, and therefore which is digitally encoded as it is.

The voice processing DSP 30 receives the singing voice signal picked up or collected by an input device such as a microphone 27 through a preamplifier 28 and an A/D converter 29, as well as various information such as the main melody pattern data, harmony melody pattern data and phoneme data. The voice processing DSP 30 generates a harmony voice signal having the tone of the original singer of the karaoke song over a main melody sung by the karaoke singer according to the input information. The generated signal is fed to the sound effect DSP 20.

The instrumental accompaniment sound signal generated by the sound source device 18, the chorus voice signal generated by the voice data processor 19, and the singing voice signal and harmony voice signal generated by the voice processing DSP 30 are concurrently fed to the sound effect DSP 20. The effect DSP 20 adds various sound effects, such as echo and reverb, to the instrumental sound and voice signals. The type and depth of the sound effects added by the effect DSP 20 is controlled based on the effect control data included in the song data. The effect control data is fed to the effect DSP 20 at predetermined timings according to the effect control sequence program under the control of the CPU 10. The effect-added instrumental sound signal and the voice signals are converted into an analog audio signal by a D/A converter 21, and then fed to an amplifier/speaker 22. The amplifier/speaker 22 constitutes an output device, and amplifies and reproduces the audio signal.

The character generator 23 generates character patterns representative of a song title and lyrics corresponding to the input character code data. The LD changer 24 reproduces a background video image corresponding to the input video image selection data (chapter number). The video image selection data is determined based on the genre data of the karaoke song, for instance. As the karaoke performance is started, the CPU 10 reads the genre data recorded in the header of the song data. The CPU 10 determines a background video image to be displayed according to the genre data. The CPU 10 sends the video image selection data to the LD changer 24. The LD changer 24 accommodates five laser discs containing 120 scenes, and can selectively reproduce 120 scenes of the background video image. According to the image selection data, one of the background video images is chosen to be displayed. The character data and the video image data are fed to the display controller 25, which superimposes them with each other for display on the video monitor 26.

Figure 2:
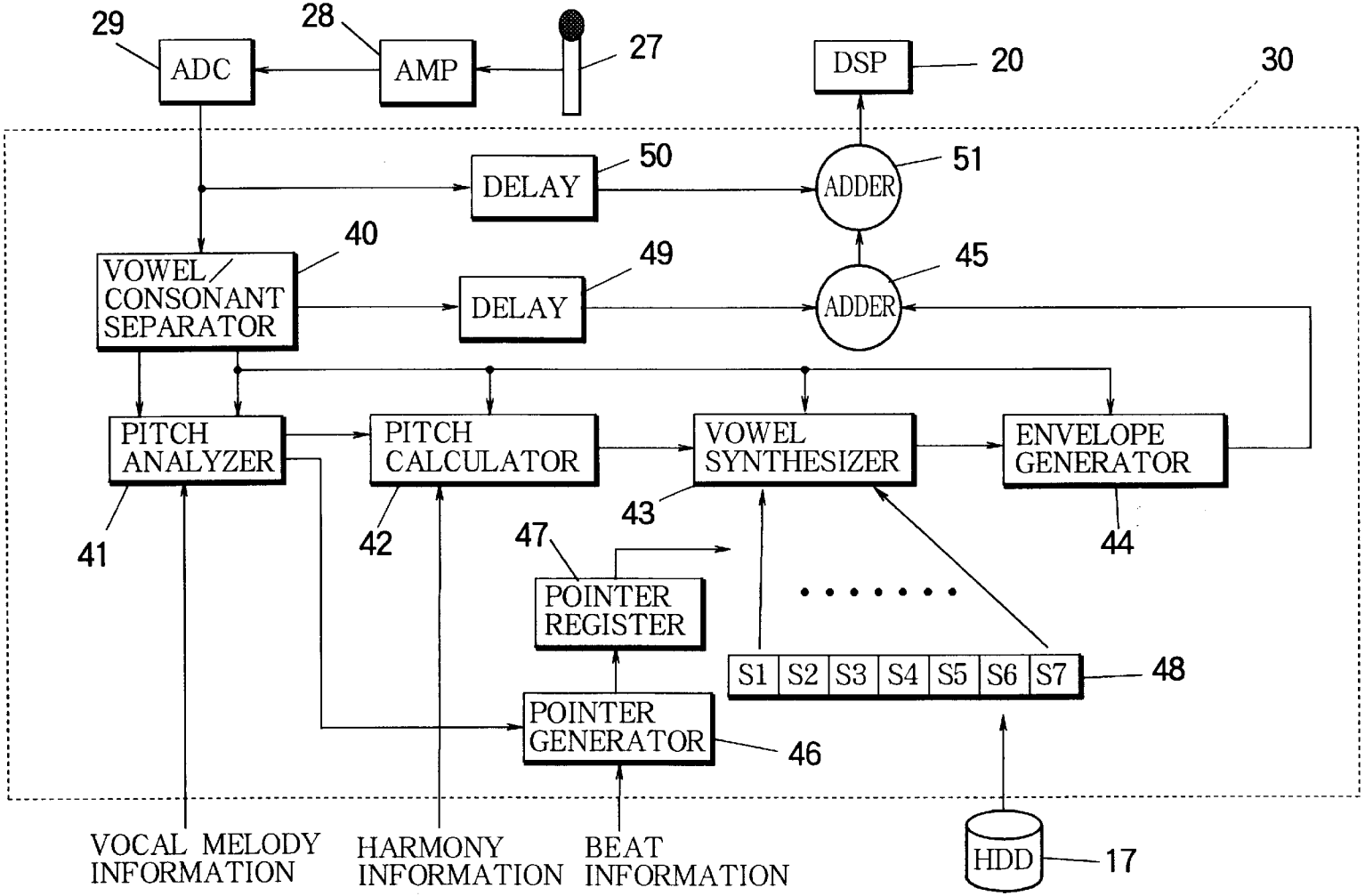
FIG. 2 shows a structure of a voice processing DSP provided in the karaoke apparatus.

FIG. 2 shows a detailed operational structure of the voice processing DSP 30. The voice processing DSP 30 executes various data processings as shown by blocks in FIG. 2 for the input audio signal according to a built-in microprogram. Referring to FIG. 2, phoneme data of the original singer are stored in a phoneme data register 48. A phoneme pointer generator 46 specifies which phoneme should be read out. The specified phoneme data is sent to a vowel synthesizer 43 to produce the harmony voice signal. The harmony voice is mixed with the karaoke singer's voice signal. The mixed signals are acoustically reproduced. The harmony voice synthesis process is explained in detail below.

The phoneme data s1, s2, . . . included in the phoneme data track and fed from the HDD 17 are sequentially entered into the phoneme data register 48, while the duration data e1, e2, . . . are fed to the phoneme pointer generator 46. In the karaoke performance, the phoneme pointer generator 46 receives a syllable detection signal from a pitch analyzer 41 as well as beat information from the CPU 10. The phoneme pointer generator 46 recognizes which syllable of the lyric is being sung, and generates a pointer which designates the phoneme data corresponding to the recognized syllable in terms of an address of the register 48 where the designated phoneme data is stored. The generated pointer is temporarily stored in a phoneme pointer register 47. The phoneme data addressed by the phoneme pointer register 47 is read out by the vowel synthesizer 43. Namely, the register 48 stores the voice information in the form of a sequence of phonetic elements which are provisionally sampled syllable by syllable from a singing voice of the virtual player. Further, the vowel synthesizer 43 successively reads out each phonetic element from the register 48 in synchronization with the karaoke accompaniment to synthesize each syllable of the harmony voice corresponding to each syllable of the singing voice.

A vowel/consonant separator 40 and a delay 50 receive the digitized singing voice signal inputted by the microphone 27 through the preamplifier 28 and the A/D converter 29. The vowel/consonant separator 40 separates consonant and vowel components of one syllable from each other by analyzing the digitized singing voice signal. The vowel/consonant separator 40 feeds the consonant component to a delay 49, while the vowel component is sent to the pitch analyzer 41. The consonant and vowel components can be separated from each other by detecting a fundamental frequency or a waveform of the singing voice signal. The pitch analyzer 41 detects a pitch (audio frequency) and a level of the input vowel component.

The detection is executed in real time, and the detected pitch information or analyzed audio frequency is fed to a pitch calculator 42, while the detected level information is fed to the vowel synthesizer 43 and to an envelope generator 44. Further, the pitch analyzer 41 is provided with vocal melody information retrieved from the vocal melody track and representative of a main melody pattern after which the actual player sings the karaoke song, and traces the main melody pattern according to the detected pitch of the singing voice to thereby detect each syllable of the singing voice. The syllable currently being sung is detected by the tracing, and the detected syllable information is distributed to the phoneme pointer generator 46. Basically, the phoneme pointer generator 46 increments the phoneme pointer according to the detected syllable information. For this purpose, the tracking of the singing voice of the karaoke singer is carried out. If the input timing of the syllable information and the count-up timing of the duration data by the beat information deviate from each other by wider than a predetermined value, compensation is effected to take an average timing between the input timing of the detected syllable and the count-up timing of the duration data.

The pitch calculator 42 detects which note is being sung in response to the input pitch data and the main melody information. Based on the detection, the pitch calculator determines which harmony note should be generated according to the harmony information which is provided from the harmony track of the song data and which represents a harmony melody pattern. Namely, the memory device stores harmony information representative of a melody pattern of the harmony voice, and the pitch calculator 42 shifts the analyzed audio frequency of the singing voice according to the stored harmony information to set an adequate audio frequency for the harmony voice. The vowel synthesizer 43 generates the vowel signal at the pitch specified by the pitch calculator 42 based on the phoneme data distributed by the phoneme data register 48. Namely, the vowel synthesizer 43 synthesizes a vowel component of the harmony voice having the shifted pitch and the waveform specified by the phoneme data. The vowel signal generated by the vowel synthesizer 43 is fed to the envelope generator 44. The envelope generator 44 receives the level information of the vowel component from the separator 40 in real time, and controls the level of the vowel signal received from the vowel synthesizer 43 according to the level information. The vowel signal added with an envelope specified by the level information is fed to an adder 45.

On the other hand, the delay 49 delays the consonant signal fed from the vowel/consonant separator 40 for a certain interval identical to the vowel processing time in the blocks including the pitch analyzer 41, the pitch calculator 42, the vowel synthesizer 43 and the envelope generator 44. The delayed consonant signal is fed to the adder 45. The adder 45 produces a composite harmony voice signal by coupling the consonant component separated from the singing voice of the karaoke singer to the harmony vowel signal of the original singer of the karaoke song generated according to the vowel information. Thus, it is possible to synthesize the final harmony voice signal matching nicely to the singing voice of the karaoke singer according to the information relating to the consonant component, and the pitch and level of the singing voice, while maintaining the tone of the original singer as well. The generated harmony voice is mixed with the singing voice of the karaoke singer in an adder 51. The original singing voice signal is delayed in the delay 50 to compensate for the processing time required in the harmony voice signal generating process. The mixed singing and harmony voices are fed to the effect DSP 20.

The voice processing DSP 30 operates as described above, and achieves the generation of the harmony voice signal having the tone of the original singer and matching nicely to the main melody sung by the karaoke singer. In the embodiment described above, the vowel extracted from the original song is stored as phoneme data. However, the phoneme data to be stored is not limited to that extent. For example, typical pronunciations in Japanese standard syllabary may be stored for use in determining phoneme data and in synthesizing a vowel by analyzing a karaoke singing voice. Further, in the embodiment above, the phoneme data track of the song data records only the vowel data of the original or model singer, and the harmony voice signal is generated using the consonant signal of the karaoke singer. Alternatively, the consonant component of the model singer can be also recorded on the phoneme data track, and the harmony signal waveform may be composed of the vowel and consonant components of the model singer.

As described in the foregoing, in the karaoke apparatus according to the present invention, based on the vocal characteristics of a particular person such as an original singer, the harmony voice signal having those characteristics can be generated over the singing voice signal of the karaoke player, so that the karaoke singer can enjoy karaoke performance as if he or she sings in duet with a virtual player such as the original singer of the karaoke song.

What is claimed is:

1. A karaoke apparatus for producing a karaoke accompaniment which accompanies a singing voice of an actual player and for concurrently creating a harmony voice originating from a virtual player, the apparatus comprising:

a memory device that stores voice information of the virtual player;

an input device that collects the singing voice of the actual player;

an analyzing device that analyzes an audio frequency of the collected singing voice;

a synthesizing device that processes the stored voice information based on the analyzed audio frequency to synthesize the harmony voice having another audio frequency, said another audio frequency being set so as to be in harmony with the analyzed audio frequency; and an output device that mixes the collected singing voice and the synthesized harmony voice with each other, and that outputs the mixed singing and harmony voices along with the karaoke accompaniment.

2. The karaoke apparatus according to claim 1, wherein the memory device also stores harmony information representative of a melody pattern of the harmony voice, and the synthesizing device shifts the analyzed audio frequency according to the stored harmony information to set said another audio frequency of the harmony voice.

3. The karaoke apparatus according to claim 1, further comprising a sound source that generates the karaoke accompaniment according to song data specifying a pitch and timing of the karaoke accompaniment.

4. The karaoke apparatus according to claim 1, wherein the voice information stored by the memory device includes consonant components and vowel components sampled from the virtual player.

5. A karaoke apparatus for producing a karaoke accompaniment which accompanies a singing voice of an actual player and for concurrently creating a harmony voice originating from a virtual player the apparatus comprising:

a memory device that stores voice information of the virtual player;

an input device that collects the singing voice of the actual player;

an analyzing device that analyzes an audio frequency of the collected singing voice;

a synthesizing device that processes the stored voice information based on the analyzed audio frequency to synthesize the harmony voice having another audio frequency, which is set in harmony with the analyzed audio frequency; and an output device that mixes the collected singing voice and the synthesized harmony voice with each other, and that outputs the mixed singing and harmony voices along with the karaoke accompaniment, wherein the memory device stores the voice information in the form of a sequence of phonetic elements which are successively sampled syllable by syllable from a singing voice of the virtual player.

6. The karaoke apparatus according to claim 5, wherein the synthesizing device successively reads out phonetic elements from the memory device in synchronization with the karaoke accompaniment, in order to synthesize each syllable of the harmony voice in correspondence with each syllable of the singing voice.

* * * * *